US008500578B2

(12) United States Patent
Mohr et al.

(10) Patent No.: US 8,500,578 B2
(45) Date of Patent: Aug. 6, 2013

(54) ELASTIC GRIP SLEEVE AND GRIP CAP FOR BALL GAME RACKET

(75) Inventors: Stefan Mohr, Dornbirn (AT); Daniel Lau, Dornbirn (AT); Ralf Schwenger, Weiler-Simmerberg (DE); Johan Kotze, Wolfurt (AT); Harald Rosenkranz, Lauterach (AT)

(73) Assignee: Head Technology GmbH, Kennelbach (AT)

( * ) Notice: Subject to any disclaimer, the term of this patent is extended or adjusted under 35 U.S.C. 154(b) by 250 days.

(21) Appl. No.: 12/971,085

(22) Filed: Dec. 17, 2010

(65) Prior Publication Data

US 2011/0152017 A1 Jun. 23, 2011

(30) Foreign Application Priority Data

Dec. 18, 2009 (DE) ..... 10 2009 058 896
Dec. 18, 2009 (DE) ..... 10 2009 058 897

(51) Int. Cl.
*A63B 49/08* (2006.01)

(52) U.S. Cl.
USPC ..... 473/549

(58) Field of Classification Search
USPC ..... 473/549, 553, 551
See application file for complete search history.

(56) References Cited

U.S. PATENT DOCUMENTS 4,265,448 A * 5/1981 Anderson, Jr. ..... 473/553
4,828,261 A 5/1989 Kleylein
5,000,452 A * 3/1991 Kuebler ..... 473/549
5,145,171 A * 9/1992 Head et al. ..... 473/300
5,238,620 A 8/1993 Wu et al.
5,827,129 A 10/1998 Huang
6,089,996 A * 7/2000 Hsu ..... 473/523
6,106,417 A * 8/2000 Umlauft et al. ..... 473/537
8,052,547 B2 * 11/2011 Nusbaum et al. ..... 473/457
8,282,514 B2 * 10/2012 Kapheim et al. ..... 473/549
2004/0071918 A1 4/2004 Cohen
2006/0135295 A1 * 6/2006 Szelenyi ..... 473/519
2006/0201957 A1 * 9/2006 Harrington et al. ..... 220/787
2009/0232587 A1 9/2009 Wang
2010/0248857 A1 * 9/2010 Gill ..... 473/298
2011/0152017 A1 * 6/2011 Mohr et al. ..... 473/549
2012/0190487 A1 * 7/2012 Kapheim et al. ..... 473/549

FOREIGN PATENT DOCUMENTS

DE 24 54 431 A1 8/1976

(Continued)

OTHER PUBLICATIONS

DE Office Action dated Nov. 25, 2010, Application No. 10 2009 058 896.
DE Office Action dated Nov. 26, 2010, Application No. 10 2009 058 897.

(Continued)

*Primary Examiner* — Raleigh W Chiu
(74) *Attorney, Agent, or Firm* — Hoffman & Baron, LLP

(57) ABSTRACT

The present invention relates to an elastic grip sleeve for the grip of a ball game racket, the sleeve having an inner surface and an outer surface, wherein the inner surface is provided at least in parts with an adhesive strip. The present invention moreover relates to a retrofit kit for a ball game racket, comprising a grip sleeve and at least an adhesive strip. Moreover, according to the invention there is provided a method for attaching a grip sleeve to the grip portion of a ball game racket.

15 Claims, 6 Drawing Sheets

FOREIGN PATENT DOCUMENTS

| | | | |
|---|---|---|---|
| DE | 28 05 314 | A1 | 8/1979 |
| DE | 2805314 | A1 | 8/1979 |
| DE | 34 14293 | A1 | 10/1985 |
| DE | 3414293 | A1 | 10/1985 |
| DE | 10 2007 007 499 | A1 | 8/2008 |
| DE | 102007007499 | A1 | 8/2008 |
| EP | 0 315 423 | B1 | 1/1992 |

OTHER PUBLICATIONS

Office Action issued on Nov. 26, 2010 for DE Patent Application No. 10 2009 058 897.3.

Search Report for a counterpart foreign application, dated Apr. 21, 2011.

* cited by examiner

ELASTIC GRIP SLEEVE AND GRIP CAP FOR BALL GAME RACKET

CROSS-REFERENCE TO RELATED APPLICATIONS

This application claims the benefit of German Application No. DE 10 2009 058 897.3, filed Dec. 18, 2009, and claims the benefit of German Application No. DE 10 2009 058 896.5, filed Dec. 18, 2009, the contents of all of which are incorporated by reference herein.

FIELD OF THE INVENTION

The present invention relates to an elastic grip sleeve or tube for the grip or handle of a ball game racket as well as to a method for attaching a grip sleeve to the grip or handle portion of a ball game racket. The application also relates to a retrofit kit or equipment for a ball game racket and a grip cap for a ball game racket.

BACKGROUND OF THE INVENTION

The grip portion of ball game rackets, in particular of tennis, squash or badminton rackets, is normally provided with a grip tape wrapped around the grip portion. These grip tapes are intended to allow the player to grip the ball game racket comfortably and hold it firmly. Moreover, some grip tapes are able to absorb sweat of the player to a certain extent. In the course of time, however, these grip tapes wear down due to the high stress and the influence of sweat, so that the grip tapes have to be replaced from time to time. To this end, the old grip tape is removed and a new grip tape is wound on the grip portion of the ball game racket.

However, the application of a new grip tape is often not easy and requires some experience. In particular, the grip tape should be as uniformly as possible, this means that no unevenness or edges should be formed when wrapping the tape around the grip portion. Moreover, the grip tape should be attached tightly enough so that it does not move when playing with the racket. Attaching a new grip tape therefore can be troublesome and time-consuming even for experienced players.

Furthermore, grip sleeves for ball game rackets are known, e.g., from U.S. Pat. No. 5,238,620. However, it is intended that the manufacturer mounts these grip sleeves on the grip portion of a ball game racket. It is not intended that the player replaces these grip sleeves or attaches a new grip sleeve to the grip portion of a ball game racket. Thus, it is not possible for the player to replace the grip sleeve himself/herself and therefore in a cost-efficient manner from time to time.

SUMMARY OF THE INVENTION

In view of the above, it is an object of the present invention to provide a cover layer for grip portions of ball game rackets, which can be attached by a player to the grip portion without much effort. Moreover, i.a. the above-mentioned problems should be taken into account. Furthermore, it is an object of the present invention to provide a method according to which a grip sleeve can be attached easily to the grip portion of a ball game racket. These and further objects are achieved by the features of the independent claims. The dependent claims describe preferred embodiments of the invention.

The present invention relates to an elastic grip sleeve for the grip of a ball game racket, the grip sleeve having an inner surface and an outer surface, wherein the inner surface is provided at least in parts with an adhesive. The grip sleeve is substantially a tubular structure (i.e. not wound), in particular from an elastic material, which can be slipped over the grip or a grip portion of a ball game racket. The elasticity of the grip sleeve allows a slight expansion in its diameter, so that it can be slipped over the grip portion or shaft of a ball game racket without any problems. The elasticity is particularly advantageous if the grip portion does not have a constant cross-section but has a slightly conical shape. In particular at the end of the grip portion, where normally a grip cap is arranged, the grip portion has as a rule an enlarged cross-section, so that the grip sleeve should be elastically expanded there.

The adhesive that is provided at the inner surface of the elastic grip sleeve allows a good connection between the inner surface of the grip sleeve and the outer surface of the grip portion. Thus, the elastic grip sleeve is fixed in such a manner at the grip of the ball game racket that it does not move, even under the load that occurs when playing with the racket.

According to a preferred embodiment, the adhesive is provided in the form of at least one adhesive strip extending substantially in the longitudinal direction of the grip sleeve. Preferably, adhesive strips are provided at two opposite sides of the inner surface. However, it is also possible that three, four or more adhesive strips are attached to the inner surface of the grip sleeve. The adhesive strip(s) is/are preferably realized by a double-sided adhesive tape.

Moreover, it is preferred that a non-tacky cover layer or liner is arranged on the adhesive or adhesive strip. The cover layer is preferably longer than the adhesive strip, preferably at least twice as long as the adhesive strip. As will become clear below on the basis of the description of the method of the invention, the elastic grip sleeve can be easily attached to the grip of a ball game racket by means of the non-tacky cover layer, which is at least twice as long as the adhesive strip.

The present invention also relates to a retrofit or exchange kit for a ball game racket, comprising a grip sleeve and at least one adhesive strip. The adhesive strip is preferably provided in the form of a double-sided adhesive tape. Moreover, it is preferred that the retrofit kit comprises at least two adhesive strips.

The adhesive strip(s) in the retrofit kit is/are preferably provided on both sides with a non-tacky cover layer or liner. This means that each adhesive strip or each double-sided adhesive tape comprises two cover layers. One of the two cover layers is preferably longer than the adhesive strip, particularly preferably at least twice as long as the adhesive strip.

The present invention further relates to a tennis or squash racket comprising a grip portion, wherein an elastic grip sleeve is adhered or bonded around the grip portion.

According to the invention, there is moreover provided a method for attaching a grip sleeve to the grip portion of a ball game racket. According to the method of the invention, at first at least one double-sided adhesive tape is applied to the inner side of the grip sleeve, wherein the side of the double-sided adhesive tape opposite to the inner surface is provided with a non-tacky cover layer, which is at least twice as long as the adhesive tape and preferably projects from an end of the grip sleeve and is substantially flush with the opposite end of the grip sleeve. The grip sleeve is then slipped on the grip portion, wherein after slipping on, the cover layer is folded on itself at least in the portion of the adhesive tape. This folding can take place either before slipping on the grip sleeve or while slipping on the grip sleeve. Finally, the cover layer is pulled out between grip sleeve and grip portion, so that the grip sleeve is attached to the grip portion by means of the double-sided adhesive tape.

In particular two advantages are achieved by the non-tacky cover layer that is folded on itself. On the one hand, the grip sleeve can be slipped on the grip portion of the ball game racket without much resistance because the non-tacky cover layer covers the double-sided adhesive tape. Thus, an adhesive connection during slipping on is prevented. On the other hand, the folding of the non-tacky cover layer allows this cover layer to be pulled out easily between grip sleeve and grip portion. If the cover layer were not folded, it would be necessary to shear the cover layer against the adhesive layer when pulling out the cover layer. Because of the folding, however, the cover layer is only removed from the adhesive layer, for which action clearly less forces are necessary.

According to a further method according to the invention for attaching a grip sleeve to the grip portion of a ball game racket, at least one double-sided adhesive tape is applied to the grip portion, wherein the side of the double-sided adhesive tape opposite to the grip portion is provided with a non-tacky cover layer, which is at least twice as long as the adhesive tape. The grip sleeve is then slipped on the grip portion, wherein after slipping on, the cover layer is folded on itself at least in the portion of the adhesive tape. Finally, the cover layer is pulled out between grip sleeve and grip portion, so that the grip sleeve is attached to the grip portion by means of the double-sided adhesive tape.

The grip sleeve is preferably made of one or a combination of the following materials: leather, synthetic leather, plastics and the like. The grip sleeve has preferably a wall thickness between 0.5 mm and 5 mm, particularly preferably between 1 mm and 3 mm. Moreover, it is preferred that the grip sleeve has characteristics which vary in sections along its length and/or along its circumference. Thus, the grip sleeve can be adapted, e.g., to the ergonomics of the player's hand. It is also preferred that along its length and/or along its circumference, the grip sleeve has a thickness and/or an elasticity module which varies in sections. Also this allows the provision of grip sleeves that are adapted to the ergonomics or to particular preferences of the player.

Since it might probably be necessary to remove the grip cap at the end of the grip portion for replacing the grip sleeve of the invention, it is particularly preferred that a ball game racket comprising the grip sleeve of the invention has a removable grip cap. According to the invention, there is further provided a ball game racket comprising a grip sleeve as described above, which racket has a substantially sleeve-shaped or tubular grip portion which has an opening at its end, which opening can be closed or is closed by means of a grip cap. The grip cap locks in the grip portion by means of a snap mechanism, and this snap mechanism can be released for removing the grip cap from the grip portion. The grip cap comprises at least two elongate elements having a length that is greater than the diameter of the grip cap, wherein a locking means is provided at the ends of each of the elongate elements.

Independent of the grip sleeve described above, the present invention further relates to a grip cap for a ball game racket having a substantially sleeve-shaped or tubular grip portion which has an opening at its end, which opening can be closed by means of the grip cap. The grip cap is realized so as to lock in the grip portion by means of a snap mechanism. The snap mechanism can be released for removing the grip cap from the grip portion. The grip cap comprises at least two elongate elements having a length that is greater than the diameter of the grip cap. A locking means is provided at the ends of each of the elongate elements. The invention further relates to a ball game racket comprising a grip cap of this kind.

The grip cap can be easily attached to the grip portion of the ball game racket by means of the snap mechanism and removed therefrom by simply releasing the snap mechanism. To this end, the grip portion preferably comprises two grooves with corresponding projections or recesses, which receive the elongate elements and allow locking of the locking means. When changing the grip sleeve of the invention, the grip cap can thus be removed from the racket shaft and again put on the racket shaft as soon as a new sleeve has been slipped on the grip portion.

Because of the relatively great length of the elongate elements it is guaranteed that the grip cap is firmly attached to the grip portion of the ball game racket and is suitable, i.a., for absorbing torsion forces. The elongate elements preferably have a length between 4 cm and 10 cm, particularly preferably between 5 cm and 8 cm.

The grip cap is preferably made of plastics, but it can also be manufactured from another material. Here, in particular elastic materials are advantageous, because the elongate elements can then lock elastically.

According to a preferred embodiment, the grip cap comprises two elongate elements with a locking means each. However, it is also possible to provide three, four, five or six elongate elements of this kind. The elongate elements are preferably realized as long snap hooks, but they can also provide for the locking mechanism in any other way.

According to a preferred embodiment, an elastic grip sleeve is adhered around the grip portion of the ball game racket. The grip sleeve covers the grip cap preferably at least in sections. The grip sleeve can, e.g., be made of one or a combination of the following materials: high density polyethylene (HDPE), low density polyethylene (LDPE), polypropylene, polyamide. The grip sleeve preferably has a thickness between 0.5 mm and 5 mm, preferably between 1 mm and 3 mm.

The elastic grip sleeve is realized such that it can be slipped over the grip portion of the racket shaft. To this end, however, it is advantageous if the grip cap is not attached to the grip portion. Since, however, the grip cap of the present invention can be released easily from the grip portion, an already slipped on grip sleeve can be removed easily from the racket shaft and replaced by a new elastic grip sleeve. Then, the grip cap can be mounted again on the racket shaft by locking.

According to a further preferred embodiment, the characteristics of the grip sleeve vary in sections along its length and/or along its circumference. According to a particularly preferred embodiment, the grip sleeve has a thickness and/or an elasticity which varies in sections along its length and/or along its circumference. Thus, the elastic grip sleeve can be adapted to the ergonomic particulars of specific ballplayers. For example, the design of the contact surfaces of the fingers could be different from that of the contact surface of the thumb.

BRIEF DESCRIPTION OF THE DRAWINGS

In the following, preferred embodiments of the present invention are described in more detail on the basis of the Figures in which.

DETAILED DESCRIPTION OF THE INVENTION

Figure 1:
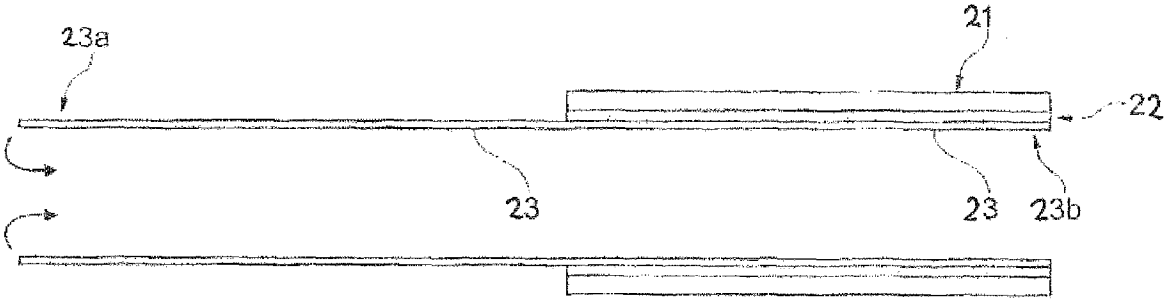
FIG. 1 is a sectional view of a grip sleeve of the invention.

FIG. 1 shows a sectional view of a preferred embodiment of the elastic grip sleeve 21 of the invention. The inner surface of the elastic grip sleeve 21 is provided at least in parts with an adhesive 22, e.g., in the form of one or more adhesive strips. A non-tacky cover layer or liner 23 is arranged on the adhesive 22, said cover layer 23 having somewhat more than twice the length of the adhesive layer 22. The non-tacky cover layer 23 is arranged on the adhesive 22 in such a manner that one end 23*a* of the cover layer 23 projects from the end of the grip sleeve 21 while the other end 23*b* of the cover layer 23 is approximately flush with the other end of the elastic grip sleeve.

The elastic grip sleeve 21 can be manufactured from a material from which conventional grip tapes are made. Preferred are, i.a., the following materials: leather, synthetic leather, plastics. All materials that are well suitable for the connection of said sleeve materials with a grip portion of, e.g., carbon fiber composites, aluminum or plastics can be used for the adhesive. In particular, it is preferred that the adhesive 22 is present in the form of a double-sided adhesive tape. An example of a suitable adhesive tape is a double-sided adhesive tape with PET carrier from 3M.

Figure 2:
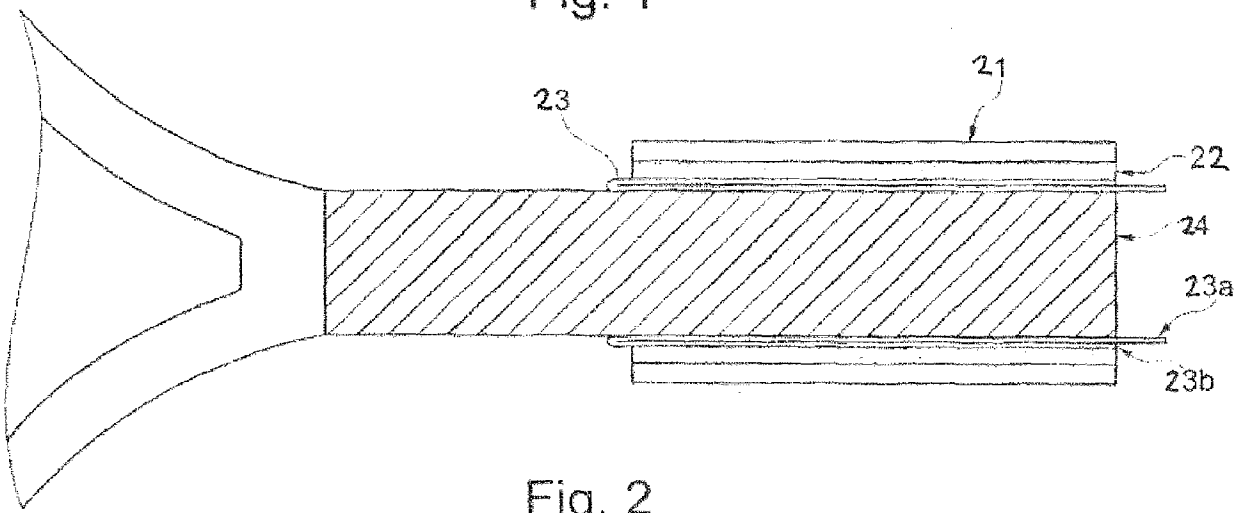
FIG. 2 is a sectional view of a grip portion of a ball game racket to which the sleeve of the invention according to FIG. 1 is attached.

For applying the elastic grip sleeve 21 to the grip portion 24 (see FIG. 2) of a ball game racket, according to the invention the grip portion 24 is inserted from the left in FIG. 1 into the interior of the elastic grip sleeve 21. The ends 23*a* of the cover layer 23 are turned inwardly in accordance with the arrows in FIG. 1, so that the one end 23*a* of the cover layer 23 comes to lie on the other end 23*b* and the cover layer 23 is folded on itself at least in the portion in which adhesive 22 is provided. FIG. 2 shows the situation in which the cover layer 23 has already been folded on itself and the elastic grip sleeve 21 has been slipped completely on the grip portion 24 of the ball game racket. The cover layer 23 can be folded either before the elastic grip sleeve is slipped on the grip portion of the racket or while it is slipped on. If folding takes place during slipping on, there is the advantage that during slipping on only cover layer slides on cover layer. In any case, however, during slipping on, the outer surface of the grip portion 24 does not come in contact with the adhesive 22 because the cover layer 23 is provided therebetween.

Since the cover layer has preferably somewhat more than twice the length of the adhesive strip 22, the ends 23*a* of the cover layer 23 project slightly from the ends of the elastic grip sleeve 21 in the folded state shown in FIG. 2. Thus, these ends 23*a* of the cover layer 23 can be gripped and the cover layer 23 can be pulled out between grip sleeve and grip portion in the rightward direction. As evident from FIG. 2, again cover layer is sliding on cover layer, so that only the so-called "peel force" must be applied for releasing the cover layer 23 from the adhesive layer 22. When the cover layer 23 has been pulled out between the grip sleeve 21 and the grip portion 24, the elastic grip sleeve 21 can be fixed by means of the adhesive layer 22 to the grip portion 24 of the ball game racket simply by pressing the grip sleeve 21 slightly onto the grip portion 24.

A so-called grip cap is often provided at the end of the grip portion 24 of a ball game racket. The cross-section of said grip cap is as a rule larger than the cross-section of the remaining grip portion. Such a grip cap might be a hindrance in slipping on the elastic grip sleeve. Thus, it is advantageous if the grip cap of the ball game racket can be removed from the grip portion for the method of the invention. Therefore, in accordance with the invention, there is provided a grip cap for a ball game racket comprising a substantially sleeve-shaped or tubular grip portion, which has on one end an opening that can be closed by means of the grip cap. The grip cap is structured such that it can lock in the grip portion by means of a snap mechanism.

Figure 3:
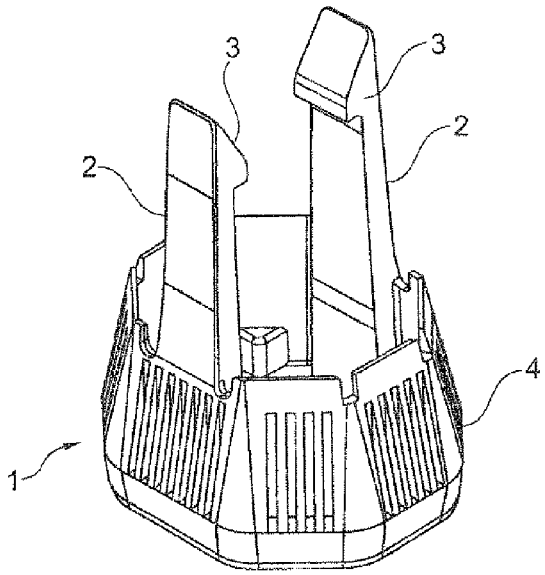
FIGS. 3 and 4 are perspective views of a preferred embodiment of the grip cap of the invention.
Figure 4:
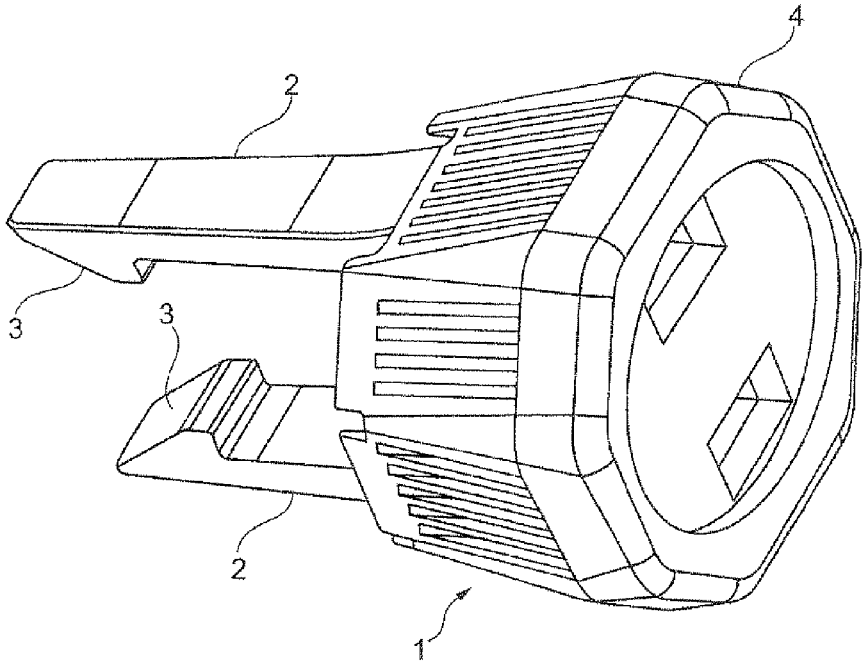

FIGS. 3 and 4 show perspective views of a preferred embodiment of the grip cap 1 of the invention. The grip cap 1 comprises a base element 4 as well as two elongate elements 2, wherein a locking means 3 is provided at the ends of each of the elongate elements. In this embodiment, the base element 4 is slightly conical and has an octagonal cross-section. However, the base element 4 can have any desired shape that is known from conventional grip portions. For example, the cross section of the base can be, i.a., round, elliptic or polygonal, in particular hexagonal or octagonal. Even if a slightly conical shape of the base element 4 is preferred, the base element 4 does not have to be conical.

Figure 5:
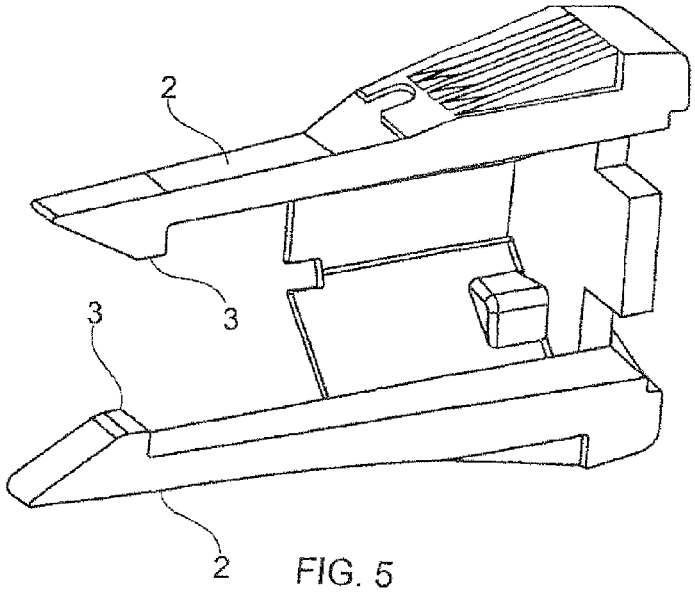
FIG. 5 is a perspective sectional view of the grip cap according to FIGS. 3 and 4.

The perspective sectional view of FIG. 5 makes clear that the elongate elements or snap hooks 2 extend substantially along the entire length of the grip cap 1. As evident from the dimensioning in the front view of FIG. 6, according to the invention the length L of the elongate elements or snap hooks 2 is greater than the diameter D of the grip cap.

Figure 6:
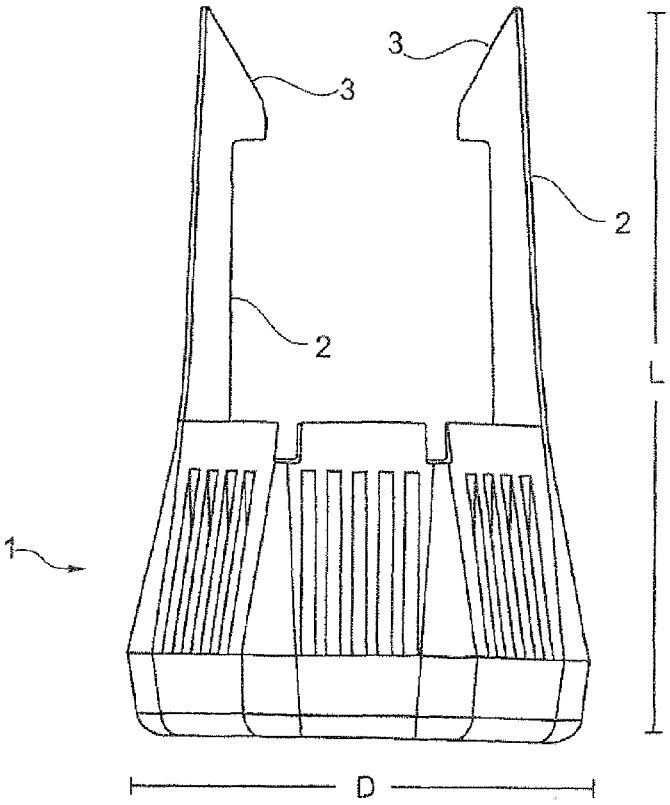
FIG. 6 is a front view of the grip cap according to FIGS. 3 and 4.
Figure 7:
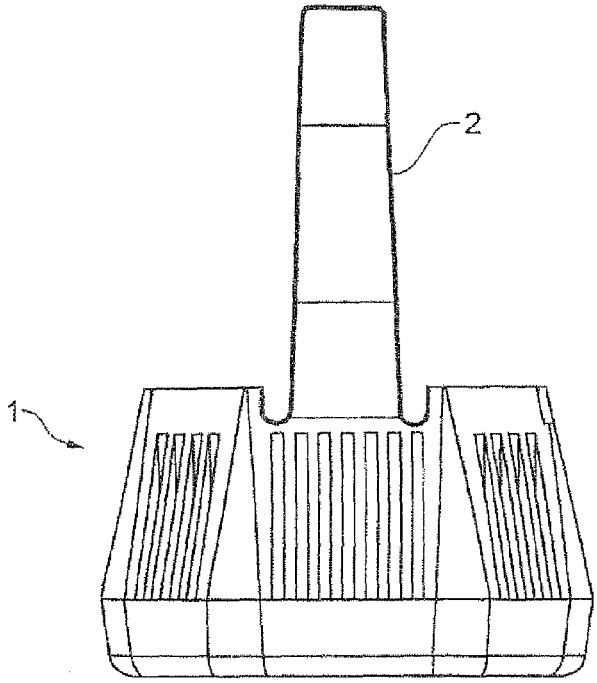
FIG. 7 is a side view of the grip cap according to FIGS. 3 and 4.

FIG. 7 shows a side view of the grip cap according to FIGS. 3 to 6.

Figure 8:
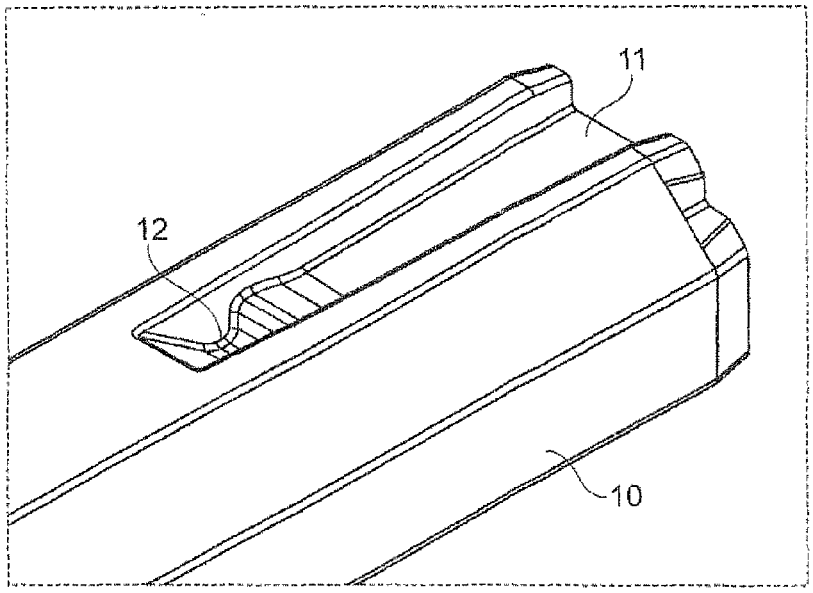
FIG. 8 is a perspective view of a racket shaft or grip portion of the invention.
Figure 9:
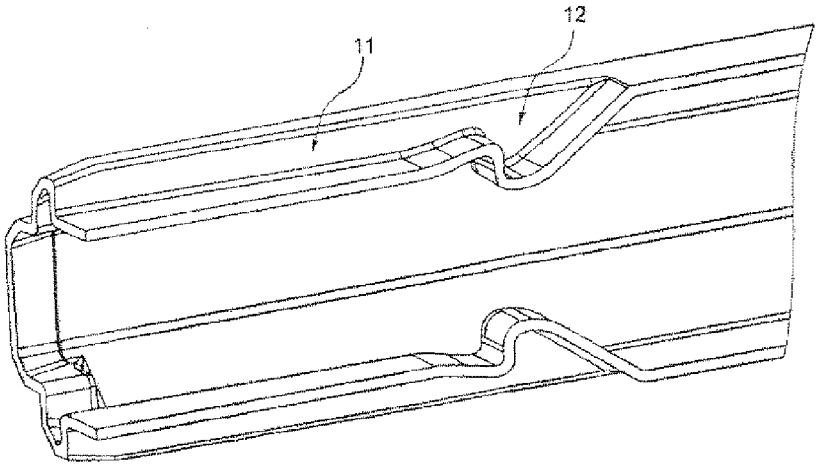
FIG. 9 is a perspective sectional view of the racket shaft according to FIG. 8.
Figure 10:
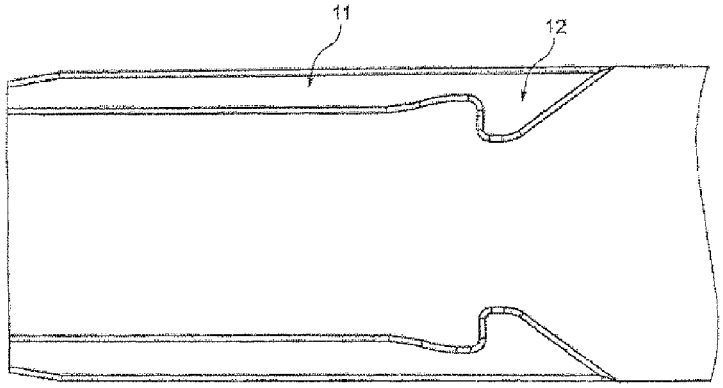
FIG. 10 is a sectional view of the racket shaft according to FIG. 8.

FIG. 8 shows a perspective view of a grip portion or racket shaft 10. FIGS. 9 and 10 show a perspective sectional view and a sectional view, respectively. The grip portion 10 of the ball game racket of the invention comprises two substantially opposite grooves 11, which can receive the elongate elements 2 of the grip cap 1. The ends of the grooves 11 comprise projections with recesses 12, in which the locking means 3 of the grip cap 1 can lock. By lifting the locking means 3 out of the openings 12, the locking mechanism can be released so that the grip cap 1 can be removed from the racket shaft 10.

The grooves 11 in the racket shaft 10 are preferably dimensioned such that the elongate elements or snap hooks 2 of the grip cap 1 can be received therein in a largely accurately fitting manner. Because of the relatively great length of the elongate elements 2, it is possible to fix the grip cap 1 extremely well at the racket shaft 10. Moreover, torsion forces can be absorbed by the elongate elements.

If the grip cap 1 is fixed to the racket shaft 10, the grip portion together with the elongate elements 2 of the grip cap 1 can be wrapped by a grip tape or can be covered by an elastic grip sleeve or an elastic grip sleeve can be bonded thereto. Then the elongate elements 2 are at least partially invisible and the grip portion 10 can be gripped comfortably. While it is possible to change the grip tape or the grip sleeve without removing the grip cap 1, it is preferably intended that also the grip cap 1 is removed from the racket shaft or grip portion 10 when changing the elastic grip sleeve. To this end, at first the elastic grip sleeve is preferably opened, e.g., by means of a knife for allowing a mechanical access to the locking means 3 of the elongate elements 2. By lifting the locking means 3, the locking mechanism can then be released and the grip cap can be removed from the racket shaft. Then, a new elastic grip sleeve can be put or slipped over the racket shaft. Subsequently, the grip cap 1 is again attached to the grip portion 10, wherein the elongate elements 2 are received in the grooves 11 of the racket shaft 10 and thus come to rest below the grip sleeve.

The preferred embodiments of the grip cap of the invention as well as of the racket shaft as described above are only exemplary. As already pointed out, in particular the base element 4 of the grip cap 1 can be varied as desired. Also the locking mechanism can be designed in a different manner. Moreover, the number of elongate elements is not restricted to two. Rather, also three, four or more elongate elements or snap hooks can be provided at the grip cap.

When mounting the elastic grip sleeve of the invention on a grip portion 10 in accordance with FIG. 6, first the grip sleeve is slipped on the grip portion 10 as described above, wherein the grip cap 1 has been removed. When the situation shown in FIG. 2 has been reached, the grip cap 1 is placed on the grip portion 10/24 in such a manner that the elongate elements 2 are introduced between the grooves 11 and the cover layers 23 until the locking means 3 lock in the recesses 12. When attaching the grip cap, the grip cap thus does not come in contact with the adhesive layer 22. Since the grip cap 1 is slightly conical, as shown in FIG. 3, the end of the elastic grip sleeve 21 is slightly expanded when inserting the grip cap 1.

When the grip cap is locked at the grip portion and the elastic grip sleeve is positioned correctly, the cover layer 23 can be pulled out as described above, so that then the elastic grip sleeve 21 is fixed by adhesion by means of the adhesive layer 23 to the grip portion 24 or the grip cap 1.

It became clear that by means of the grip sleeve of the invention and the method of the invention, in particular in connection with the grip cap of the invention, it is possible for the player to use, instead of a grip tape (having the disadvantages described above), a grip sleeve that can be exchanged easily in a few steps. This exchange can be done by the player himself/herself without having to think about the best wrapping or a good seat of the sleeve. The grip sleeve of the invention can be used flexibly, manufactured in a cost-efficient manner and moreover allows a cost-efficient exchange by the player himself/herself.

The invention claimed is:

1. A grip cap and a grip portion for a ball game racket comprising:

a substantially tubular grip portion which has an opening on one end, said opening being closable by means of a grip cap, wherein the grip cap is constructed for locking in the grip portion by means of a snap mechanism and wherein the snap mechanism can be released for removing the grip cap from the grip portion, wherein the grip cap comprises at least two elongate elements which have a length that is greater than the diameter of the grip cap, wherein a locking means is provided at the ends of each elongate element, and wherein the locking means of the at least two elongate members are adapted to engage the grip portion from outside or with an outer surface of the grip portion.

2. The grip cap and grip portion according to claim 1, wherein the elongate elements have a length between 4 cm and 10 cm.

3. The grip cap and grip portion according to claim 1, wherein the grip cap is made of plastics.

4. A ball game racket comprising:

a substantially sleeve-shaped or tubular grip portion which has an opening on one end, said opening being closable by means of a grip cap, wherein the grip cap locks in the grip portion by means of a snap mechanism and wherein the snap mechanism can be released for removing the grip cap from the grip portion, wherein the grip cap comprises at least two elongate elements which have a length that is greater than the diameter of the grip cap, wherein a locking means is provided at the ends of each elongate element, and wherein the locking means of the at least two elongate members are adapted to engage the grip portion of the ball game racket from outside or with an outer surface of the grip portion.

5. The ball game racket according to claim 4, wherein the elongate elements have a length between 4 cm and 10 cm.

6. The ball game racket according to claim 4, wherein the grip cap is made from plastics.

7. The ball game racket according to claims 4, wherein an elastic grip sleeve is bonded around the grip portion.

8. The ball game racket according to claim 7, wherein the grip sleeve covers the grip cap at least in parts.

9. The ball game racket according to claim 7, wherein the grip sleeve is made of one or a combination of the following materials: high density polyethylene (HDPE), low density polyethylene (LDPE), polypropylene, polyamide.

10. The ball game racket according to claim 7, wherein the grip sleeve has a thickness between 0.5 mm and 5 mm.

11. The ball game racket according to claim 7, wherein the grip sleeve has characteristics which vary in sections along its length and/or along its circumference.

12. The ball game racket according to claim 7, wherein the grip sleeve has a thickness and/or an elasticity module which varies in sections along its length and/or along its circumference.

13. The grip cap and grip portion according to claim 1, wherein the elongate elements have a length between 5 cm and 8 cm.

14. The ball game racket according to claim 4, wherein the elongate elements have a length between 5 cm and 8 cm.

15. The ball game racket according to claim 7, wherein the grip sleeve has a thickness between 1 mm and 3 mm.

* * * * *